United States Patent [19]

Scott

[11] 4,342,575

[45] Aug. 3, 1982

[54] BAG TOP COVER ASSEMBLY FOR A VACUUM CLEANER

[75] Inventor: Ernest R. Scott, Mayfield Hts., Ohio

[73] Assignee: The Scott & Fetzer Company, Lakewood, Ohio

[21] Appl. No.: 305,193

[22] Filed: Sep. 24, 1981

[51] Int. Cl.[3] ..... B01D 46/04

[52] U.S. Cl. ..... 55/378; 55/381; 55/473; 15/350; 15/351

[58] Field of Search ..... 55/378, 379, 381, 382, 55/473; 15/350, 351; D32/22

[56] References Cited

U.S. PATENT DOCUMENTS

| | | | |
|---|---|---|---|
| D. 222,593 | 11/1971 | McFarland | D32/22 |
| 4,182,618 | 1/1980 | Tschudy | 55/378 |
| 4,240,812 | 12/1980 | Schaefer et al. | 55/381 |
| 4,262,384 | 4/1981 | Bowers | 55/378 |

*Primary Examiner*—Bernard Nozick

*Attorney, Agent, or Firm*—Pearne, Gordon, Sessions, McCoy & Granger

[57] ABSTRACT

An upright vacuum cleaner having a motor housing, a handle pivotally attached to the housing, and a flexible dirt-receiving bag extending between the housing and the handle is disclosed. A top cover assembly is provided for supporting the top of the bag, and includes a rectangular cup-shaped cover having top, side, and end faces enveloping a portion of the top of the bag. An attaching assembly is provided for attaching the cover to the handle and to the top of the bag within the cover. The attaching assembly includes a wire hanger extending through the top face of the cover and then extending from a location adjacent one end of the cover toward the other end of the cover. The attaching assembly further includes a clamping web fixed to the underside of the top face. Downwardly and inwardly extending ends of the web enter pleats at the sides of the bag to removably hold the bag in place within the cover.

9 Claims, 6 Drawing Figures

BAG TOP COVER ASSEMBLY FOR A VACUUM CLEANER

BACKGROUND OF THE INVENTION

This invention relates to vacuum cleaners, and more particularly to upright vacuum cleaners of the type having a wheeled motor housing adapted to mount an on-the-floor or off-the-floor cleaning attachment. Such a vaccum cleaner has a handle pivotally connected to the housing for ease of operation during on-the-floor cleaning operations, and has a flexible dirt-collecting bag extending from an exhaust fan outlet to a connection at the upper portion of the handle.

Early vacuum cleaners of this type include a dirt bag which is more or less symmetrically located with respect to the vertical axis of the cleaner, and which merely relies upon retention of the dirt on the walls of the bag. To clean such a bag, the lower portion of the bag is removed from its connection to the motor housing and the contents of the bag are emptied on or into a collecting means such as a newspaper or paper bag.

Later vacuum cleaner models such as those shown in U.S. Pat. No. 4,262,384 and U.S. Pat. Des. No. D222,593 provide for a dirt-collecting box mounted on one side of the motor housing with an exhaust outlet, assymetrically located with respect to the axis of the cleaner, to facilitate dirt discharge and removal from the cleaner.

In each such arrangement, the bag extends from the exhaust outlet to an upper portion of the handle and is connected to the upper portion of the handle by a ring on the bag which cooperates with a spring clasp or snap hook attached to the handle. Generally speaking, the spring clasp or snap hook is attached to a wire which is similar to a wire coat hanger having inwardly turned ends which support the top of the dirt-collecting bag. In some instances, the wire and a portion of the top of the bag are covered with an enveloping plastic sleeve which fits over the top of the bag and compresses the top of the bag into a flat, rectangular configuration.

With such arrangements, the flexible bag tends to be flexed from a normal upright position, which detracts from the appearance of the cleaner, and the upper portion of the bag is constricted by the bag mounting arrangement which includes the enveloping plastic sleeve. A mounting arrangement which constricts the upper portion of the bag not only detracts from the appearance of the cleaner but, more importantly, may not provide optimum dirt filtering capacity for an external dirt-collecting bag, or may distort an internally contained disposable bag, with similar results.

SUMMARY OF THE INVENTION

This invention provides a bag top cover assembly for a vacuum cleaner that results in a tailored bag appearance and which does not constrict or confine the top of the bag to any significant extent so that the filtering capacity of the bag is substantially unimpaired and, in the case of an outer bag having a disposable inner bag, promotes ease of installation of the inner disposable bag.

According to this invention, an improved top cover assembly for a vacuum cleaner bag is disclosed. The cover assembly comprises a rectangular, cup-shaped cover having top and side faces which envelop a portion of the top of the flexible dirt-receiving bag. The cover assembly is attached to the vacuum cleaner handle by a hanger, and the hanger supports the cover assembly as a cantilever. The hanger is a wire which extends through the top face of the cover and has a pair of parallel legs which extend from a location adjacent one end of the cover toward the other end of the cover. A top clamping web or bar is fixed to the bottom of the top face of the cover so that the clamping bar clamps the legs against the underside of the top face. The clamping bar has downwardly and then inwardly turned legs which removably support the flexible dirt-collecting bag by entering upper side folds formed in the bag.

DETAILED DESCRIPTION OF THE DRAWINGS

Figure 1:
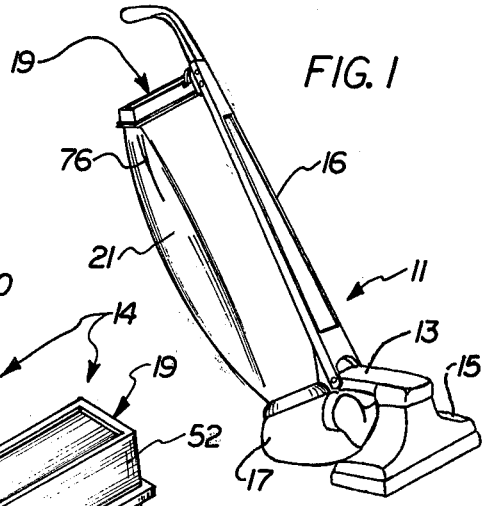
FIG. 1 is a perspective view of a vacuum cleaner having a top cover assembly for a flexible bag in accordance with this invention.

There is illustrated in FIG. 1 a vacuum cleaner 11 which includes a handle 16 pivoted to a motor housing 13. The vacuum cleaner 11 further includes a rug-engaging nozzle 15, a dirt-collecting box 17, a bag-mounting assembly 19, and a flexible dirt-receiving bag 21.

The vacuum cleaner 11 has a quick-disconnect coupling 10 between a first coupling member 12 and a second coupling member 14. The first coupling member 12 is fixed to the handle 16 of the upright vacuum cleaner 11 by a screw 18.

The first coupling member 12 includes a pocket which is defined by parallel sidewalls 20 and 22, which are joined by a connecting web 24. The pocket is open at the top and bottom, and a top web 26 further connects the sidewalls 20 and 22. In order to restrain the pocket from rotation about the screw 18, the handle is provided with an upper projection 28 against which the web 26 abuts and a lower projection 30 which extends between the sidewalls 20 and 22. The screw 18 passes through the web 26 and through a leaf spring 32 which is normally biased against a horizontal projection 34 of the web 24.

Figure 3:
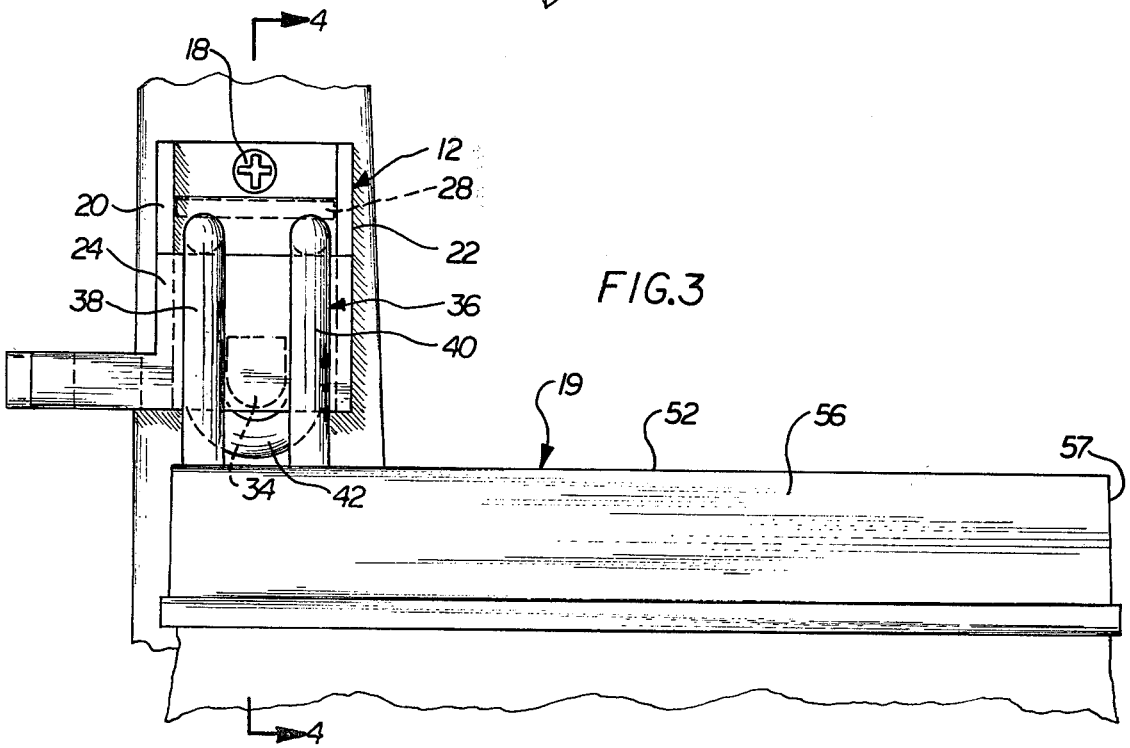
FIG. 3 is a fragmentary, elevational view of the vacuum cleaner handle and the vacuum cleaner bag, showing the coupled connection between those members.
Figure 4:
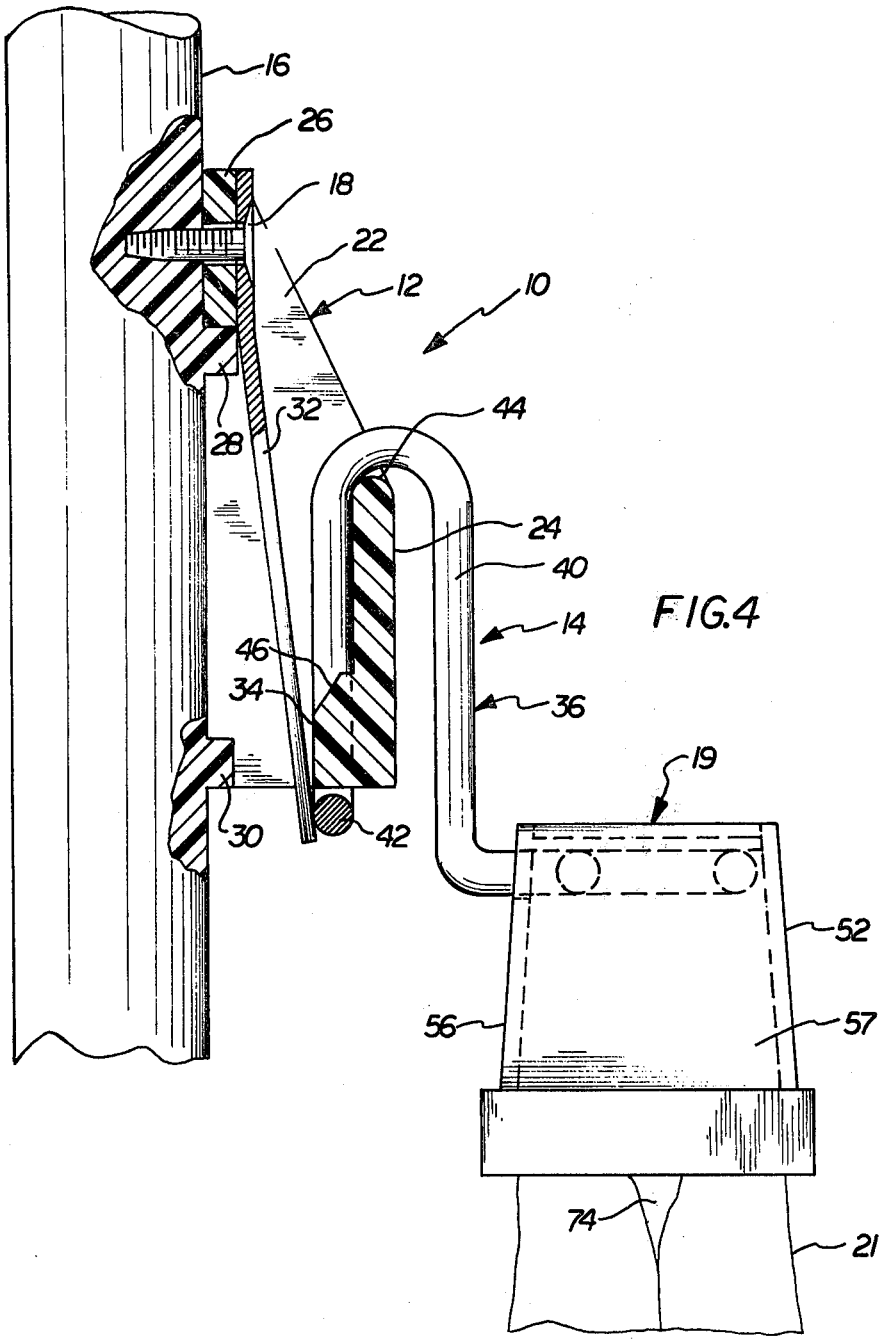
FIG. 4 is a side elevational view, partly in section, illustrating the coupled connection between the vacuum cleaner handle and the vacuum cleaner bag.

The second coupling member 14 includes a hook-shaped wire 36 which is received within the pocket of the first coupling member 12. The wire 36 extends upwardly from the bag mounting assembly 19, and then downwardly into the pocket of the first coupling member 12. The wire 36 has a pair of parallel legs 38 and 40 having a U-shaped portion 42 which enters the pocket of the first coupling member 12. The second coupling member 14 is attached to the first coupling member 12 by hooking the wire 36 over a lip 44 of the web 24. The U-shaped portion 42 is guided downwardly against the bias of the spring 32 by a beveled portion 46 of the horizontal projection 34 until the U-shaped portion 42 is retained beneath the projection 34 by the spring 32, as illustrated in FIG. 3. To release the second coupling member 14 from the first coupling member 12, the bag is pushed toward the handle 16 to rock the wire 36 about the lip 44 so that the hook-shaped portion 42 forces the leaf spring 32 toward the handle to permit the second coupling member 14 to be lifted upwardly out of the pocket.

As may be noted, the wire 36 is securely retained in the pocket and is held against twisting movement by the horizontal projection 34, since, as may be seen in FIG. 3, that projection has a width which is only slightly less than the spacing between the legs 38 and 40. Furthermore, the sidewalls 20 and 22 are spaced apart a distance which is slightly greater than the width of the hook-shaped wire received within the pocket.

Figure 2:
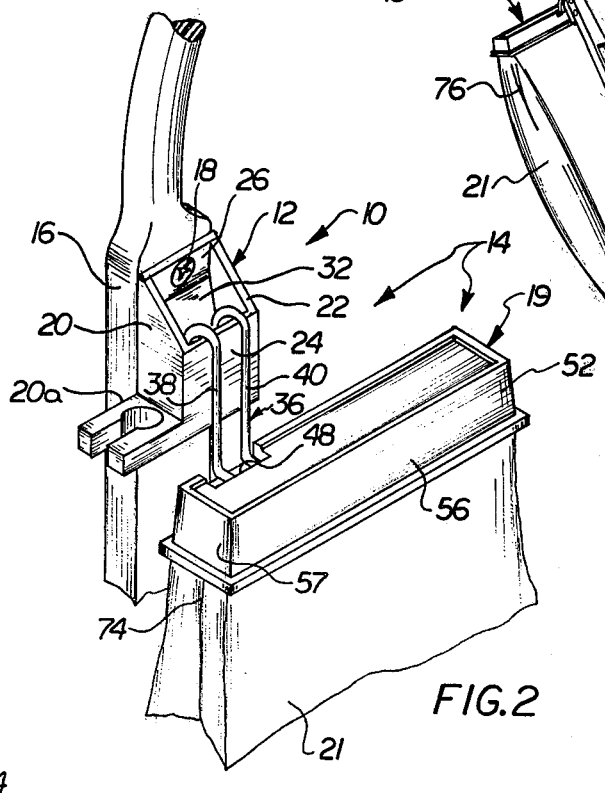
FIG. 2 is a fragmentary, perspective view of the handle of the vacuum cleaner, having a flexible dirt-receiving bag in coupled relationship thereto.
Figure 5:
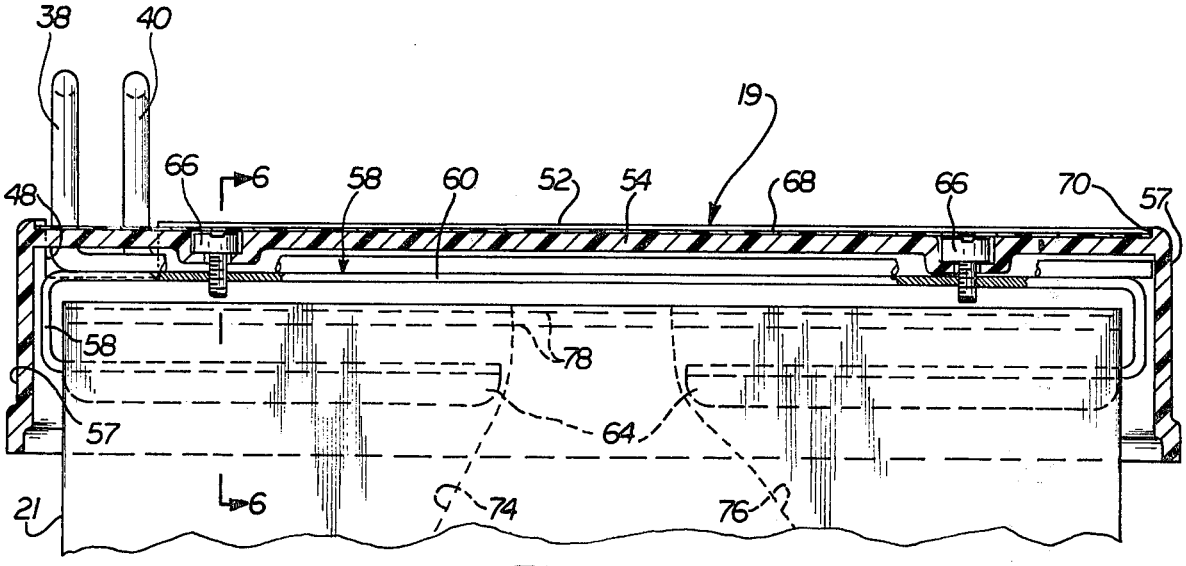
FIG. 5 is a fragmentary, elevational view, partly in section, illustrating the support arrangement between the top casing and the vacuum cleaner bag.
Figure 6:
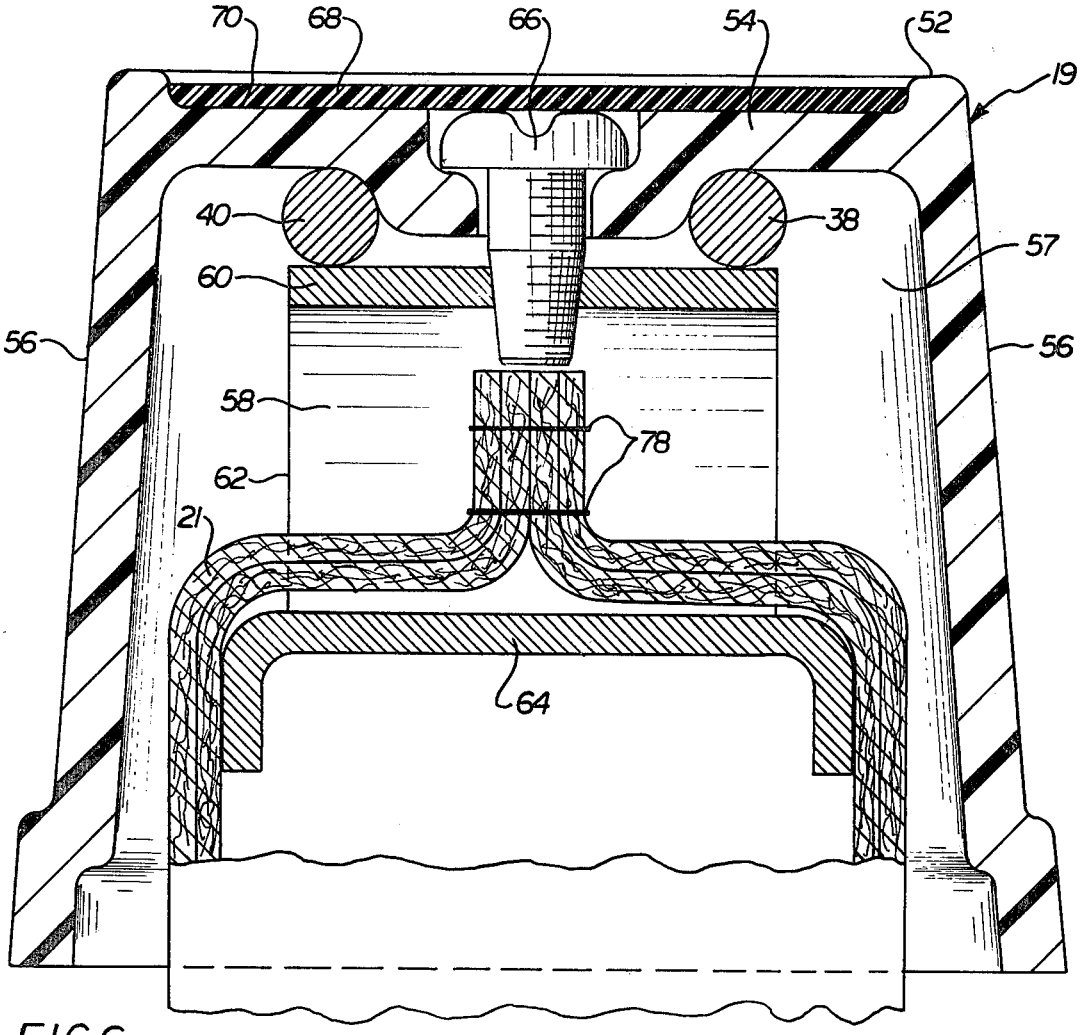
FIG. 6 is a cross-sectional view, the plane of the section being indicated by the line 6—6 in FIG. 5.

Referring now to FIGS. 5 and 6, the wire legs 38 and 40 project through apertures 48 and 50 provided in a rigid top bar casing 52 of the bag mounting assembly 19. The top bar casing 52 is preferably made from plastic, and comprises an inverted, rectangular cup having a top wall 54 and depending side and end walls 56 and 57, respectively. As may be noted in FIG. 2, the legs 38 and 40 enter the apertures 48 and 50 in a plane which is substantially parallel to the longitudinal axis of the casing 52. As is indicated in FIGS. 2 and 5, the leg 38 is bent toward a sidewall 56, and then extends toward the opposite end wall 57. The leg 40 is bent to extend directly toward the opposite end wall 57, and is parallel to the leg 38 within the casing 52. Thus, the casing 52 is supported as a cantilever by the wire 36.

A bag hanger bracket 58 is provided within the casing 52, and includes a top web 60, depending legs 62, and inwardly turning bag support arms 64. The top web 60 is attached to the underside of the top wall 54 by screws 66 so that the web 60 clamps the legs 38 and 40 firmly against the inner side of the top wall 54. In order to conceal the screws 66, a pressure-sensitive adhesive laminate 68 may be provided in a recessed portion 70 of the top wall 54. If desired, model identification or other indicia may be provided on the surface of the laminate 68.

The flexible dirt-receiving bag 21 is suspended from the hanger bracket 58. The bag 21 is preferably constructed from a tightly woven, conventional filter cloth material, and is provided with side pleats 74 and 76 which are tucked in, and the top of the bag is sewn together along seams 78.

Thus, side pockets are formed in the bag 21 and the bag is mounted so that the arms 64 enter each side pleat. It may be noted in FIG. 6 that the arms 64 are relatively wide, so that the bag 21 tends to fill the cup-shaped top casing 52 to afford a tailored appearance to the bag, and so that the bag appears to be an extension of the cup-shaped top casing as to its length and width dimensions.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. In an upright vacuum cleaner having a motor housing, a handle pivotally connected to said housing, and a flexible dirt-receiving bag extending between said housing and said handle, in combination therewith, the improvement comprising a top casing assembly for supporting the top of said bag, said top casing assembly comprising a rectangular cup-shaped cover having top, side, and end faces enveloping a portion of the top of said bag, attaching means attaching said cover to said handle and to the top of said bag within said cover, said attaching means including a wire hanger extending through the top face of said cover, said hanger extending from a location adjacent one end of said cover toward the other end of said cover, said attaching means further including clamping web means, means to fix said web means to the underside of the top face of said cover so that said web means clamps said wire against the underside of said top face, and means to attach said bag to said web means so that said enveloped portion of said bag substantially fills the longitudinal and lateral dimensions of said cover.

2. The improvement according to claim 1, wherein said wire hanger has a pair of parallel legs extending from said location adjacent said one end of said cover toward said other end of said cover.

3. The improvement according to claim 1, wherein said means to attach said bag to said web means includes downwardly depending and inwardly turned end portions of said web means.

4. The improvement according to claim 3, wherein said dirt-receiving bag is provided with side pleats and wherein said inwardly turned end portions enter said side pleats to removably support said bag.

5. The improvement according to claim 4, wherein the inwardly turned end portions have a width which is sufficient to spread the bag to an extent such that the bag substantially fills the lateral dimension of said cover.

6. In an upright vacuum cleaner having a motor housing, a handle pivotally connected to said housing, and a flexible dirt-receiving bag extending between said housing and said handle, in combination therewith, the improvement comprising a top casing assembly for supporting the top of said bag, said top casing assembly comprising a rectangular cup-shaped cover having top, side, and end faces enveloping a portion of the top of said bag, attaching means attaching said cover to said handle and to the top of said bag within said cover, said attaching means including a wire hanger having a pair of parallel legs extending through the top face of said cover in a plane substantially parallel to the longitudinal axis of the top face of said cover, one of said legs extending along the bottom of said top face directly toward the opposite end of said cover, the other one of said legs extending toward a side face of said cover and then toward said opposite end of said cover and parallel to said one of said legs, said attaching means further including clamping web means, means to fix said web means to the underside of the top face of said cover so that said web means clamps the legs against the underside of said top face, and means to attach said bag to said web means so that said enveloped portion of said bag substantially fills the longitudinal and lateral dimensions of said cover.

7. The improvement according to claim 6, wherein said means to attach said bag to said web means includes downwardly depending and inwardly turned end portions of said web means.

8. The improvement according to claim 7, wherein said dirt-receiving bag is provided with side pleats and wherein said inwardly turned end portions enter said side pleats to removably support said bag.

9. The improvement according to claim 8, wherein the inwardly turned end portions have a width which is sufficient to spread the bag to an extent such that the bag substantially fills the lateral dimension of said cover.

* * * * *